US007746982B2

(12) United States Patent
Yoshii et al.

(10) Patent No.: US 7,746,982 B2
(45) Date of Patent: Jun. 29, 2010

(54) ROTARY ANODE X-RAY TUBE

(75) Inventors: Yasuo Yoshii, Kawasaki (JP); Chiharu Tadokoro, Yokohama (JP); Yasutaka Ito, Kawasaki (JP); Hitoshi Hattori, Yokohama (JP); Hironori Nakamuta, Otawara (JP); Tetsuya Yonezawa, Yaita (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/211,721

(22) Filed: Sep. 16, 2008

(65) Prior Publication Data

US 2009/0080616 A1 Mar. 26, 2009

(30) Foreign Application Priority Data

Sep. 26, 2007 (JP) ..... 2007-250220

(51) Int. Cl.
*H01J 35/10* (2006.01)
*H01J 35/26* (2006.01)

(52) U.S. Cl. ..... 378/133; 378/132; 378/144

(58) Field of Classification Search ..... 378/132, 378/133, 144

See application file for complete search history.

(56) References Cited

U.S. PATENT DOCUMENTS 3,399,000 A * 8/1968 Remmers ..... 384/99
5,068,885 A 11/1991 Vetter ..... 378/133
5,541,975 A * 7/1996 Anderson et al. ..... 378/130
5,559,852 A * 9/1996 Vetter ..... 378/133
5,583,907 A * 12/1996 Ono et al. ..... 378/132
5,602,898 A * 2/1997 Vetter et al. ..... 378/132
5,668,849 A * 9/1997 Sugiura et al. ..... 378/133
5,737,387 A * 4/1998 Smither ..... 378/130
5,809,106 A * 9/1998 Kitade et al. ..... 378/132
6,430,260 B1 * 8/2002 Snyder ..... 378/130
6,477,232 B2 * 11/2002 Yoshida ..... 378/132
6,546,078 B2 * 4/2003 Ide ..... 378/133
6,636,583 B2 * 10/2003 Ratzmann et al. ..... 378/133
7,050,541 B2 * 5/2006 Bittl ..... 378/132

FOREIGN PATENT DOCUMENTS

JP 2960089 7/1999

* cited by examiner

*Primary Examiner*—Edward J Glick
*Assistant Examiner*—Thomas R Artman
(74) *Attorney, Agent, or Firm*—Ohlandt, Greeley, Ruggiero & Perle, L.L.P.

(57) ABSTRACT

In a rotary anode X-ray tube, a disc portion is fitted into a rotary anode with a first gap therebetween and a fixed shaft is fitted into a rotary shaft to support the anode with a second gap therebetween. The disc portion and the fixed shaft are formed integral with each other to have a hollow portion therein. A cooling liquid is allowed to flow through the hollow portion. A liquid metal is filled in the first and second gaps. Dynamic pressure type bearings is formed in the second gap. A passage is formed to directly communicate the first gap to the second gap, whereby the liquid metal being directly supplied from the second gap to the first gap. Thus, the liquid metal can be fed rapidly and surely into the gap between the anode target and a cooling vessel.

14 Claims, 2 Drawing Sheets

ROTARY ANODE X-RAY TUBE

CROSS-REFERENCE TO RELATED APPLICATIONS

This application is based upon and claims the benefit of priority from prior Japanese Patent Application No. 2007-250220, filed Sep. 26, 2007, the entire contents of which are incorporated herein by reference.

BACKGROUND OF THE INVENTION

1. Field of the Invention

The invention relates to a sliding bearing using a liquid lubricant and a rotary anode X-ray tube using the sliding bearing.

2. Description of the Related Art

A rotary anode X-ray tube used in an imaging diagnostic system and the like is used at a high temperature and in a vacuum, and moreover the anode target is rotated at high speed. Such a rotary anode X-ray tube is structured as disclosed in Japanese Patent 2960089 such that the rotation axis that supports the rotary anode is supported by a sliding bearing which uses a liquid metal as a lubricant. In order to further reduce the X-ray tube in size and weight, it is required to cool the rotation target through a liquid metal. For this reason, a proposal has been made for a structure such that a gap is set between the back of the rotation target and a fixed shaft and a liquid metal is injected into the gap as a heat transfer fluid to thereby cool the rotation target.

With the rotary anode X-ray tube, when the X-ray tube apparatus is operated, the anode target reaches a high temperature due to entry of heat to it. That is, the anode target is irradiated with an electron beam and consequently reaches a high temperature. In particular, the electron bombardment surface (focal point) which is struck by electrons reaches a high temperature. For this reason, the anode target must be maintained at temperatures below the melting point of its material.

From such a point of view, techniques to cool the anode target have been developed. Among the techniques is one which uses a liquid metal as a heat transfer fluid in the vicinity of the electron bombardment surface and transfers the heat of the anode target to cooling water within a cooling box, thereby cooling the anode target.

However, the conventional rotary anode X-ray tube using the liquid metal as a heat transfer fluid for cooling has the following problem:

With the cooling mechanism which uses the liquid metal as a heat transfer fluid for cooling, it is required to surely introduce the liquid metal used as a lubricant into the gap between the cooling box integral with the fixed shaft and the anode target. The amount of the liquid metal to be filled in is limited so as not to cause leakage from the seal portion when the rotating body is stopped. When the rotating body starts rotating, the liquid lubricant is pressed against the inner part of the rotating body due to centrifugal force and then introduced from the fixed shaft into the gap between the cooling box and the anode target.

However, the liquid metal needs to pass through the narrow gap in the dynamic pressure type bearings; therefore, it takes long to introduce the liquid metal into the gap between the cooling box and the anode target.

BRIEF SUMMARY OF THE INVENTION

According to an aspect of the invention, there is provided a rotary anode X-ray tube comprising:

a rotary anode being provided with a target on which an electron beam is irradiated to generate X-rays, and having a first hollow portion;

a rotary shaft supporting the rotary anode and having a second hollow portion;

a disc portion fitted into the first hollow portion of the rotary anode with a first gap therebetween and having a third hollow portion;

a fixed shaft being fitted into the rotary shaft with a second gap therebetween, and having a fourth hollow portion communicating with the third hollow portion of the disc portion;

a liquid metal filled in the first and second gaps;

a dynamic pressure type bearing portion which is formed between an inner surface of the second hollow portion of the rotary shaft and an outer surface of the fixed shaft; and a passage which directly communicate the first gap to the second gap to supply the liquid metal to the first gap from the second gap.

According to another aspect of the invention, there is provided a rotary anode X-ray tube comprising:

a rotary anode provided with a target on which an electron beam is irradiated to generate X-rays, and having a first hollow portion;

first and second rotary shafts extended from the rotary anode in opposite directions along its axis of rotation and having second hollow portions having inner surfaces to support the rotary anode;

a disc portion fitted into the first hollow portion of the rotary anode with a first gap therebetween and having a third hollow portion;

first and second fixed shafts having outer surfaces, the first and second fixed shafts being extended from the disc portion in opposite directions along the axis of rotation and being respectively fitted into the first and second rotary shafts with a second gap therebetween and having fourth hollow portions, respectively, and the third hollow portion of the disc portion and the fourth hollow portion of the first and second fixed shafts communicating with each other to allow a cooling liquid to pass therethrough;

a liquid metal filled in the first and second gaps;

first and second dynamic pressure type bearings which are formed between the inner surfaces of the second hollow portions of the first and second rotary shafts and the outer surfaces of the first and second fixed shaft, respectively; and first and second passages which directly communicate the first gap to the second gap to supply the liquid metal to the first gap from the second gap.

DETAILED DESCRIPTION OF THE INVENTION

A rotary anode X-ray tube according to an embodiment of the present invention will be described hereinafter with reference to the accompanying drawings.

Figure 1:
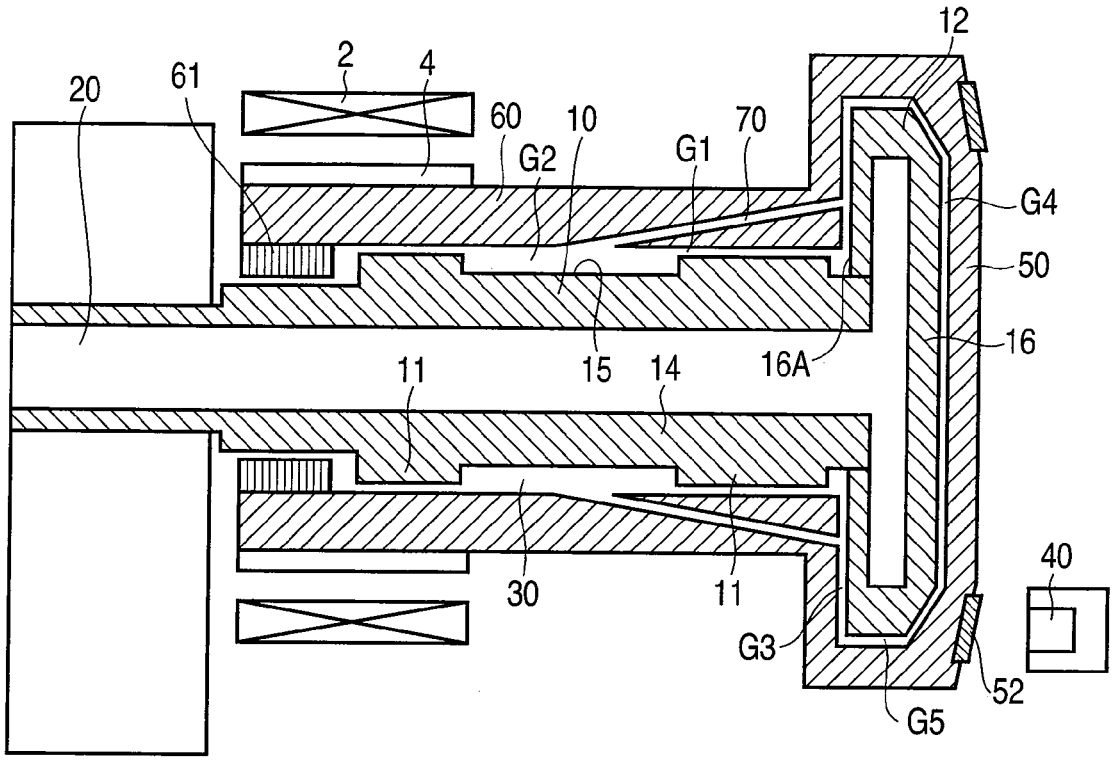
FIG. 1 is a schematic sectional view of a rotary anode X-ray tube according to an embodiment of the present invention.

As shown in FIG. 1, the rotary anode X-ray tube is composed of a cylinder-shaped fixed shaft 10 having its one end which is fixedly supported, a cylinder-shaped body 60 of rotation which is rotatably mounted to the fixed shaft 10, a hollow-disc-like rotary anode 50 which is fixed to one end of the rotary shaft 60 so as to rotate together with it, a cathode 40 which is placed opposite a target 52 of the rotary anode 60 and emits an electron beam toward the anode target 52, and a vacuum envelope (not shown) which houses these components and has been evacuated to a sufficiently low pressure.

The rotary shaft 60 is provided with a rotation producing unit 4 which is rotated together with the rotary shaft and made of a conducting material, such as copper. The rotation producing unit 4 is opposed to a stator coil 2 which is placed outside the vacuum envelope and adapted to produce a rotating magnetic field. When the rotation producing unit 4 is subjected to the rotating magnetic field from the stator coil 2, a magnetic field produced in the rotation producing unit 4 and the rotating magnetic field repel each other to generate a rotating force to rotate the rotary shaft 60.

The rotary anode X-ray tube and the stator coil 2 are accommodated in a housing (not shown) to constitute an X-ray tube apparatus. When an electron beam from the cathode 20 is directed focused onto the rotating anode target 2, X-rays are generated from the anode target and then directed to the outside through X-ray windows formed in the vacuum envelope and the housing.

As shown in FIG. 1, the fixed shaft 10 is fitted into the rotary shaft 60 so as to form gaps G1 to G5 therebetween. The gaps G1 to G5 are filled with a liquid metal 30. To prevent leakage of the liquid metal, the rotary shaft 60 is equipped at its open end with a sealing member 61 to provide liquid-tight sealing between the open end of the rotary shaft 60 and the base of the fixed shaft 10.

The fixed shaft 10 is constructed from a hollow cylinder-shaped axial portion 14 and a hollow disc portion 16 fixed to the axial portion. The axial portion 14 is formed on its circumference with a pair of radial bearings 11 which are spaced apart from each other. If the axial portion 14 can be supported by a single radial bearing, only one radial bearing will suffice.

The radial bearings 11 are each formed with a helical groove, such as a herringbone pattern. Between the radial bearings 11 is formed a depressed region 15 to store the liquid metal 30. The gap G1 between the radial bearing 11 and the inner surface of the rotary shaft 60 is set smaller than the gap G2 between the depressed region 15 and the inner surface of the rotary shaft 60. When the rotary shaft 60 is in rotation, the liquid metal 30 is supplied from the gap G2 between the depressed region 15 and the inner surface of the rotary shaft 60 to the bearing gap G1 through the pumping action of the helical groove. Therefore, the dynamic pressure in the radial direction increases through the liquid metal supplied to the bearing gap G1 between the radial bearing 11 and the inner surface of the rotary shaft 60. Thereby, the rotary shaft is supported in the radial direction by the radial bearing produced by the dynamic pressure.

Instead of forming a helical groove, such as a herringbone pattern, on each of the radial bearings 11, the helical groove may be formed in the inner surface portions of the rotary shaft 60 which are opposed to the radial bearings. It is evident that only one of the paired radial bearings 11 may be formed on the fixed shaft 10.

Figure 2:
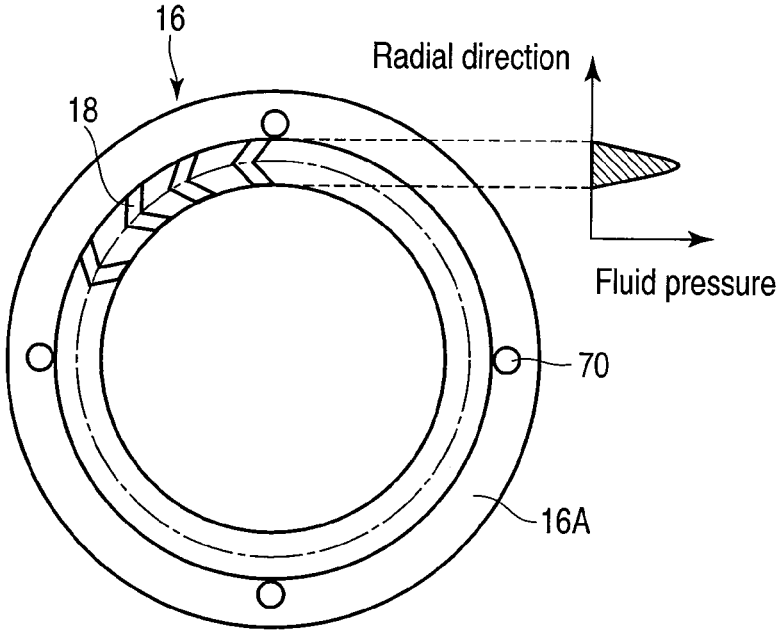
FIG. 2 is a schematic plan view illustrating a helical groove for thrust bearing which are formed on the inner surface of the rotary anode shown in FIG. 1.

The hollow disc portion 16 is fitted into the hollow disc-shaped rotary anode 50 to form the gaps G3, G4, and G5 between its portions and the inner surface of the rotary anode. That is, the outer circumferential surface of the disc 16 forms the gap G5. The ring-like flat surface 16A of the disk portion 16 which is coupled with the axial portion 14 forms the gap G4. The flat surface at the top of the disc portion 16 forms the gap G4. As shown in FIG. 2, a helical groove 18, such as a herringbone pattern, is formed in the inside region of the ring-like flat surface 16A of the disc portion 16 to form a thrust bearing between the inside region of the flat surface 16A and the inner surface of the rotary anode 50. As shown in FIG. 2, the thrust bearing supports the rotary anode 50 along the axial direction of the rotary shaft 60 through fluid dynamic pressure of the liquid metal lubricant flowed in with the rotation of the rotary anode. Likewise, a helical groove, such as a herringbone pattern, may be formed on the flat disc surface at the top of the disc portion 16 to provide another thrust bearing between the disc surface and the inner surface of the rotary anode 50.

The rotary shaft 60 is formed with pipe passages 70 in order to feed the liquid metal 30 into the gaps G3, G4 and G5 rapidly and surely at the rotation of the rotary shaft. Each of the pipe passages 70 is formed to extend obliquely and upward along a radial line of the rotary shaft 60 and has its one end opened into the gap G2 between the bearings 11 and its other end opened into the gap G3. Moreover, in the gap G3, the other open end of the pipe passage 70 is formed, as shown in FIG. 2, outside the ring-like area in which the helical groove 18 to produce fluid pressure is formed. As shown in FIG. 2, the open ends of the pipe passages 70 in the gap G3 are placed on radial lines of the rotary shaft 60 each of which forms an equal angle with the adjacent one. Likewise, the open ends of the pipe passages 70 in the gap G2 are placed on radial lines of the rotary shaft 60 each of which forms an equal angle with the adjacent one.

When the rotary shaft 60 is rotated, the liquid metal within the gap G2 is pressed against the inner surface of the rotary shaft through centrifugal force and part of it is fed into the pipe passages 70. The liquid metal fed into the pipe passages 70 is supplied to the gap G3. Here, the liquid metal within the pipe passages 70 are smoothly supplied to the thrust bearing by the pumping action of the bearing and then to the gaps G4 and G5 as well.

The hollow portion of the hollow cylinder-shaped axis 14 communicates with the hollow portion of the disc 16. Both the hollow portions are specified as a passage 20 for cooling water. The axis 14 and the disc 16 constitute a cooling vessel 12. The hollow portion of the axis 14 has its one end opened into the outside. A tube for supplying cooling water (not shown) is inserted into the open end of the axis 14. Cooling water is supplied through this tube from the cooling water source of the cooling vessel 12 to cool the disc 16. Cooling water may be directly supplied from the cooling water source of the cooling vessel 12 to the passage 20 without inserting the cooling water supplying tube into the passage.

When the X-ray tube apparatus is operated, the anode target 50 reaches a high temperature through entry of heat to it. That is, the anode target 50 is irradiated with an electron beam and consequently reaches a high temperature. In particular, the electron bombardment surface (focal point) which is struck by electrons reaches a high temperature. The heat is transferred from the anode target 30 to the liquid metal 30 within the gaps G3, G4 and G5 and then to the disc 16 through the liquid metal. The heat transferred to the disc 16 is then transferred to the cooling water within the cooling vessel 12 and emitted to the outside of the X-ray tube. With the rotation of the rotary shaft 60, the liquid lubricant 30 is supplied through the pipe passages 70 to the gaps G3, G4 and G5. Therefore, the heat transferred to the liquid metal 30 within the gaps G3, G4 and G5 are transferred to the disc 16 and effectively led to the outside of the X-ray tube through the cooling water. It is therefore possible to suppress the elevation of temperature of the rotary anode 60 and prevent the anode target 50 from reaching its melting point.

Figure 3:
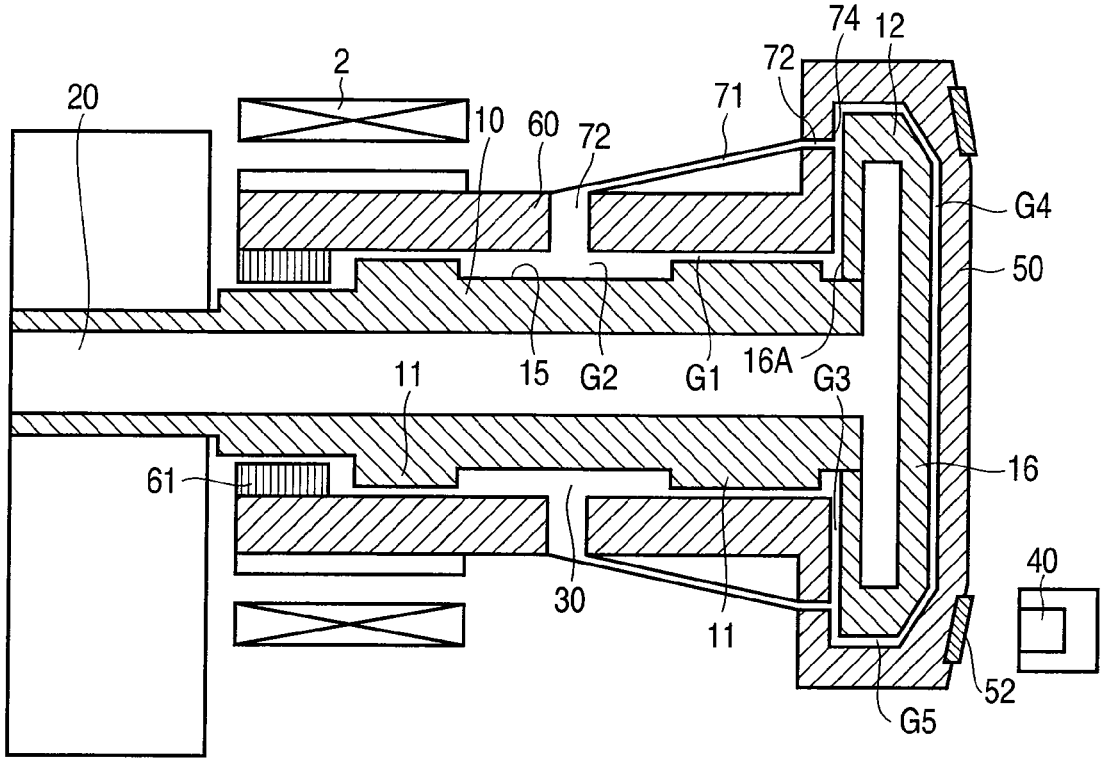
FIG. 3 is a schematic sectional view of a rotary anode X-ray tube according to another embodiment of the present invention.

FIG. 3 is a view, partially in section, of a rotary anode X-ray tube according to another embodiment of the present invention. In the X-ray tube shown in FIG. 1, the pipe passages 70 are formed in the rotary shaft 60. In contrast, in the X-ray tube of FIG. 3, pipes 71 are provided outside the rotary shaft 60. The pipes 71 may communicate with openings 74 formed in the rotary shaft 60 and openings 74 formed in the rotary anode 50. Openings 72 on the rotary shaft side are formed in the gap G2 as in the structure shown in FIG. 1, through which the liquid metal is supplied. In addition, the openings 70 on the rotary anode side are formed to communicate with the gap G3 and that are formed outside the area in which the helical groove 18 is formed to increase fluid pressure. When the rotary shaft 60 starts to rotate, therefore, the liquid lubricant 30 stored in the gap G2 is pressed against the inside of the rotary shaft due to centrifugal force and then supplied to the gaps G3, G4 and G5 through the pipes 71.

Even with the X-ray tube equipped with the pipes 71 as shown in FIG. 3, heat transferred from the rotary anode 50 to the liquid metal 30 within the gaps G3, G4 and G5 is transferred to the disc portion 16 and then effectively led to the outside of the X-ray tube through cooling water. It is therefore possible to suppress the elevation of temperature of the rotary anode 60 and prevent the anode target 50 from reaching its melting point.

Figure 4:
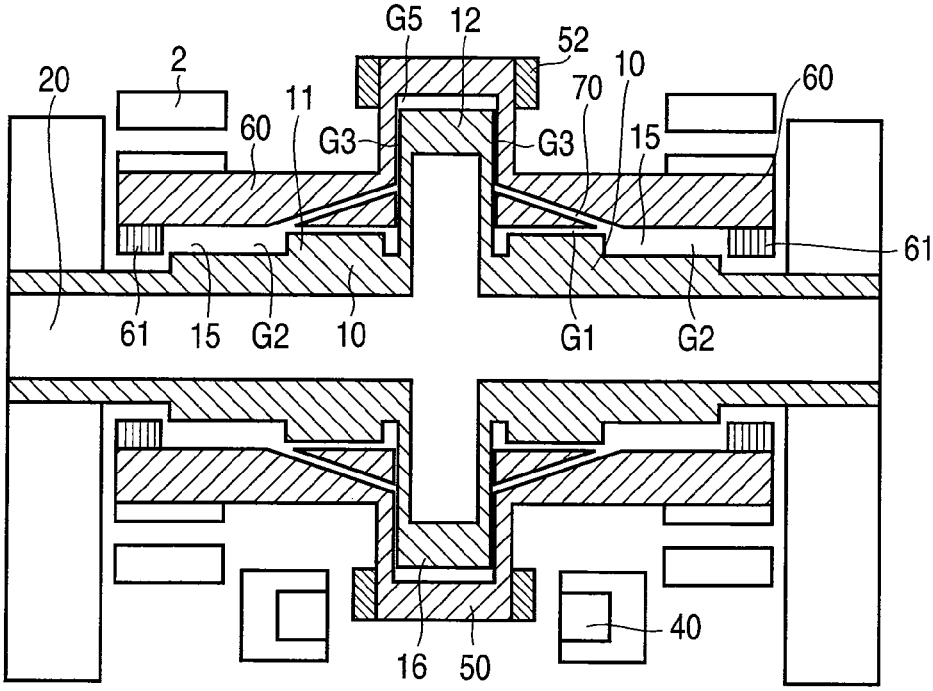
FIG. 4 is a schematic sectional view of a rotary anode X-ray tube according to still another embodiment of the present invention.

FIG. 4 is a view, partially in section, of a rotary anode X-ray tube according to still another embodiment of the present invention.

The X-ray tubes shown in FIGS. 1 and 3 adopt a cantilever structure such that the fixed shaft 10 has its one end fixed and its other end coupled to the disc portion 16 as a free end. This is not restrictive. The X-ray tube of the invention may be formed into a straddle-mounted structure such that, as shown in FIG. 4, first and second fixed shafts 10 are coupled to both sides of the disc portion 16 and extend in opposite directions along the central axis. With this straddle-mounted structure, the disc portion 16 is set between the first and second fixed shafts 10 as shown in FIG. 4. The hollow portions of the first and second fixed shafts 10 communicate with that of the disc portion 16 so that they communicate with each other to form the passage 20 for cooling water, thereby constituting a cooling structure to cool the rotary anode 50.

The straddle-mounted structure with the first and second fixed shafts 10 involves coupling to the rotary anode 50 of first and second rotary shafts 60 into which the first and second fixed shafts are fitted and which extend in opposite directions. The disc portion 16 is fitted into the rotary anode 60, which is formed with a helical groove 18 on its ring-like flat surface to provide thrust bearing.

Each of the first and second fixed shafts 10 on opposite sides of the disc portion 16 is provided with a bearing portion 11 to form a radial bearing. A depressed region 15 is formed outside the bearing 11. The rotary anode 60 is provided with seal member 61 at their both ends to prevent the liquid metal 30 from leaking to the outside. The hollow portions of the first and second fixed shafts 10 and the disc communicate with one another to constitute a cooling vessel 12 through which cooling liquid 20 flows.

Even with the X-ray tube of straddle-mounted structure shown in FIG. 4, first and second pipe passages 70 are formed in the first and second rotary shafts 70 to allow the gaps G2 and G3 to communicate with each other. The liquid metal in the gap G2 is supplied to the gap G3. Thus, the liquid metal is allowed to circulate in the gaps G1, G2, G3, and G5.

The first and second pipe passages 70 are opened into the outside of the area where the helical groove 18 is formed as shown in FIG. 2.

Even with the X-ray tube shown in FIG. 4, heat transferred from the rotary anode 50 to the liquid metal 30 within the gaps G3 and G5 is transferred to the disc portion 16 and then effectively led to the outside of the X-ray tube through cooling water. It is therefore possible to suppress the elevation of temperature of the rotary anode 60 and prevent the anode target 50 from reaching its melting point.

In the rotary anode X-ray tube of the invention, a liquid metal required to cool the anode target can be supplied to the back of the anode target directly (i.e., rapidly and surely) without passing through narrow gaps in dynamic pressure type bearings; therefore, a rotary anode X-ray tube can be provided which is provided with sliding bearings using a liquid lubricant and which is high in reliability.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A rotary anode X-ray tube comprising:

a rotary anode being provided with a target on which an electron beam is irradiated to generate X-rays, and having a first hollow portion;

a rotary shaft supporting the rotary anode and having a second hollow portion;

a disc portion fitted into the first hollow portion of the rotary anode with a first gap therebetween and having a third hollow portion;

a fixed shaft being fitted into the rotary shaft with a second gap therebetween, and having a fourth hollow portion communicating with the third hollow portion of the disc portion;

a liquid metal filled in the first and second gaps;

a dynamic pressure bearing portion which is formed between an inner surface of the second hollow portion of the rotary shaft and an outer surface of the fixed shaft; and a passage which directly communicate the first gap to the second gap to supply the liquid metal to the first gap from the second gap, wherein the passage is formed in the rotary shaft.

2. The rotary anode X-ray tube according to claim 1, wherein the passage is set in pipes provided outside the rotary shaft.

3. The rotary anode X-ray tube according to claim 1, further comprising other passages that directly communicate the first gap to the second gap to supply the liquid metal to the first gap from the second gap, wherein the other passages are formed in the rotary shaft, and wherein the passage and the other passages have their one ends opened into the first gap at regularly spaced intervals around a tube axis of the X-ray tube and other ends opened into the second gap at regularly spaced intervals around the tube axis of the X-ray tube.

4. The rotary anode X-ray tube according to claim 1, wherein the dynamic pressure bearing portion includes first and second dynamic pressure bearings placed with a space therebetween along the fixed shaft, the second gap includes a depressed region formed between the first and second dynamic pressure type bearings, and the passage is opened into the depressed region.

5. The rotary anode X-ray tube according to claim 1, wherein the disc portion has an outer ring surface which is opposed to an inner ring surface of the second hollow portion of the rotary shaft in the peripheral portion of the fixed shaft, either of the inner ring surface and the outer ring surface is formed with helical grooves in the shape of a ring, and the passages are opened on the outside of the helical grooves and communicate with the second gap.

6. The rotary anode X-ray tube according to claim 1, wherein the fixed shaft has its one end fixed.

7. The rotary anode X-ray tube according to claim 1, wherein the fixed shaft has its one end fixed.

8. A rotary anode X-ray tube comprising:

a rotary anode provided with a target on which an electron beam is irradiated to generate X-rays, and having a first hollow portion;

first and second rotary shafts extended from the rotary anode in opposite directions along its axis of rotation and having second hollow portions having inner surfaces to support the rotary anode;

a disc portion fitted into the first hollow portion of the rotary anode with a first gap therebetween and having a third hollow portion;

first and second fixed shafts having outer surfaces, the first and second fixed shafts being extended from the disc portion in opposite directions along the axis of rotation and being respectively fitted into the first and second rotary shafts with a second gap therebetween and having fourth hollow portions, respectively, and the third hollow portion of the disc portion and the fourth hollow portion of the first and second fixed shafts communicating with each other to allow a cooling liquid to pass therethrough;

a liquid metal filled in the first and second gaps;

first and second dynamic pressure bearings which are formed between the inner surfaces of the second hollow portions of the first and second rotary shafts and the outer surfaces of the first and second fixed shaft, respectively; and first and second passages which directly communicate the first gap to the second gap to supply the liquid metal to the first gap from the second gap, wherein the first and second passages are formed in the first and second rotary shafts, respectively.

9. The rotary anode X-ray tube according to claim 8, wherein each of the first and second fixed shafts is coupled to the disk portion at its one end and fixed at its other end.

10. A rotary anode X-ray tube comprising:

a rotary anode being provided with a target on which an electron beam is irradiated to generate X-rays, and having a first hollow portion;

a rotary shaft supporting the rotary anode and having a second hollow portion;

a disc portion fitted into the first hollow portion of the rotary anode with a first gap therebetween and having a third hollow portion;

a fixed shaft being fitted into the rotary shaft with a second gap therebetween, and having a fourth hollow portion communicating with the third hollow portion of the disc portion;

a liquid metal filled in the first and second gaps;

a dynamic pressure bearing portion which is formed between an inner surface of the second hollow portion of the rotary shaft and an outer surface of the fixed shaft; and a passage which directly communicate the first gap to the second gap to supply the liquid metal to the first gap from the second gap, wherein the dynamic pressure bearing portion includes first and second dynamic pressure bearings placed with a space therebetween along the fixed shaft, the second gap includes a depressed region formed between the first and second dynamic pressure bearings, and the passage is opened into the depressed region.

11. The rotary anode X-ray tube according to claim 10, wherein the passage is formed in the rotary shaft.

12. The rotary anode X-ray tube according to claim 10, wherein the passage is set in pipes provided outside the rotary shaft.

13. The rotary anode X-ray tube according to claim 10, further comprising other passages that directly communicate the first gap to the second gap to supply the liquid metal to the first gap from the second gap, wherein the other passages are formed in the rotary shaft, and wherein the passage and the other passages have their one ends opened into the first gap at regularly spaced intervals around a tube axis of the X-ray tube and other ends opened into the second gap at regularly spaced intervals around the tube axis of the X-ray tube.

14. The rotary anode X-ray tube according to claim 10, wherein the disc portion has an outer ring surface which is opposed to an inner ring surface of the second hollow portion of the rotary shaft in the peripheral portion of the fixed shaft, either of the inner ring surface and the outer ring surface is formed with helical grooves in the shape of a ring, and the passages are opened on the outside of the helical grooves and communicate with the second gap.

* * * * *

UNITED STATES PATENT AND TRADEMARK OFFICE

CERTIFICATE OF CORRECTION

PATENT NO. : 7,746,982 B2
APPLICATION NO. : 12/211721
DATED : June 29, 2010
INVENTOR(S) : Yoshii et al.

It is certified that error appears in the above-identified patent and that said Letters Patent is hereby corrected as shown below:

On the Title Pg.

Item 73

Add Second Assignee: Toshiba Electron Tubes & Devices Co., Ltd.

Signed and Sealed this
Sixth Day of December, 2011

David J. Kappos

David J. Kappos
*Director of the United States Patent and Trademark Office*